US009526359B2

(12) United States Patent
Wawrzyniak

(10) Patent No.: US 9,526,359 B2
(45) Date of Patent: Dec. 27, 2016

(54) VERSATILE SYSTEM FOR HANGING FLAT OBJECTS ON WALLS

(71) Applicant: Greg Wawrzyniak, San Diego, CA (US)

(72) Inventor: Greg Wawrzyniak, San Diego, CA (US)

( * ) Notice: Subject to any disclaimer, the term of this patent is extended or adjusted under 35 U.S.C. 154(b) by 0 days.

(21) Appl. No.: 14/544,737

(22) Filed: Feb. 10, 2015

(65) Prior Publication Data

US 2016/0227946 A1 Aug. 11, 2016

(51) Int. Cl.
*A47G 1/16* (2006.01)

(52) U.S. Cl.
CPC ..... *A47G 1/1606* (2013.01)

(58) Field of Classification Search
CPC ... A47G 1/1603; A47G 1/1606; A47G 1/1613
USPC ..... 248/222.51, 222.52, 447.1, 477, 486, 248/487, 289, 490, 497, 498, 489; 40/780, 40/790, 757; 411/501, 790
See application file for complete search history.

(56) References Cited

U.S. PATENT DOCUMENTS

| | | | | | |
|---|---|---|---|---|---|
| 2,286,539 | A * | 6/1942 | Hagerstrom | A47G 1/20 | 211/35 |
| 2,809,001 | A * | 10/1957 | Margulis | A47G 1/1606 | 248/467 |
| 3,142,124 | A * | 7/1964 | Ownbey | G09F 7/08 | 116/324 |
| 3,146,981 | A * | 9/1964 | Wheeler | A47G 1/20 | 248/301 |
| 3,881,676 | A * | 5/1975 | Reinwall | E06B 9/02 | 248/224.8 |
| 6,775,939 | B1 * | 8/2004 | Juern | A47G 1/065 | 248/489 |
| 8,196,889 | B2 * | 6/2012 | Sangiuliano | F16M 11/04 | 248/466 |
| 2006/0059759 | A1 * | 3/2006 | Roy | A47G 1/06 | 40/790 |

* cited by examiner

*Primary Examiner* — Gwendolyn Baxter

(57) ABSTRACT

A versatile mounting system for hanging flat objects on walls and vertical surfaces provides a combination of hooks interlocking with mounting members.
The system makes hanging of those flat objects, like flat panel displays, smart TVs, monitors, screens, large paintings and picture frames, quick and easy.
Hooks pivotally attach to the back panel of a flat object and are configured and positioned to lock onto corresponding mounting members anchored to the wall.
Flat objects can be hung securely anywhere on any wall, nearly flush with the wall surface. In addition, this system allows for making adjustments in pitch and level after objects are hung.

3 Claims, 16 Drawing Sheets

VERSATILE SYSTEM FOR HANGING FLAT OBJECTS ON WALLS

PRIORITY CLAIM

This patent application is the follow up filing of the provisional application No. 61/965,992 filed with the USPTO on Feb. 10, 2014 with the title: "Versatile mounting system and methods for hanging flat panel displays and similar objects on walls and flat vertical surfaces" and I would like to claim the above priority date for the present application.

Please note that some sections have been edited and expanded to better describe the present invention and to bring the most important aspects to the forefront, however, no new matter has been added.

FIELD OF THE INVENTION

The present invention generally relates to hardware fasteners that are used to secure objects to walls, and more particularly to adjustable and adaptable mounts and hangers for use with flat screen TVs, various monitors, displays, larger paintings and/or picture frames.

BACKGROUND OF THE INVENTION

Generally flat panel display mounts fall into the following categories—fixed/stationary, horizontal swivel, vertical tilting and full motion, but there are numerous types and variations thereof currently on the market.

The flat panel displays, while constantly improving picture quality and increasing in size, are gradually getting thinner and lighter, as leading manufacturers drastically reduce their weight by utilizing new and emerging technologies like OLED (organic light-emitting diodes).

This continuous weight reduction trend renders many of the heavy duty wall mounts obsolete and creates a need for suitable light weight mounting solutions.

There are already some less bulky solutions on the market, but they still have many shortcomings and none of them match the attributes and utility of the present invention.

These shortcomings are mostly a result of sloppy design, wasteful use of raw materials and duplicitous components leading to excessive weight, shipping cost and shelf space required.

Those unnecessary parts and features can confuse not only the DIY consumer but also the professional installer and make the assembly excessively time-consuming and cumbersome.

The present invention, while very simple, provides a complete, versatile and easy to install wall mount system that becomes a great time saver in the hands of any installer.

The proposed embodiments depict few variations of a mounting kit that is extremely lightweight, compact, can ship in a very small package and is very easy to understand and to install.

The system is by design highly adaptable and is generally not limited by size or mounting hole-patterns. It conforms to the standards defined by VESA (Video Electronics Standards Association). Competing systems are lacking this measure of adaptability.

In addition, the proposed mount versions allow the display panel to hang very close to the wall or flush with the wall surface.

Admittedly, this close to the wall configuration restricts tilting to some degree but still provides enough space to access plugs, cords and cables.

Tilting of the flat panel in the upward direction, is desirable for the purpose of connecting wires and cords or accessing the back of the display panel for servicing, when the unit is already hanging.

Pitch adjustments are also made possible by placing spacers/bumpers of various sizes between the wall and the bottom section of the back panel.

As more and more TV models utilize wireless technology and have cord receptacles easily accessible there is less tilting necessary.

SUMMARY

A simple, lightweight and versatile wall mount kit consisting of hooks, anchors, screws and various washers, shown in the preferred embodiments for use with flat panel displays, can be also utilized to hang other sizeable flat objects on walls and vertical surfaces quickly and easily, and a method for hanging flat panel TVs flush to the wall—back panel flush with the wall or display screen flush with the wall surface.

Hooks can be oriented outwardly (away from one another) or inwardly (toward one another), depending on the placement of points of rotatable attachment to the flat object and still function in the same way.

This system can also be installed in alternate configuration, meaning that hooks can be pivotally attached to the wall and the anchor points (sleeved washers) can be anchored to the flat object, and it will function essentially in the same way.

1. An object of the present invention is to provide a simple and lightweight wall mount system for flat panel displays that makes the modern TVs, monitors and the like easy to install.
2. It is a more particular object of the present invention to provide a simple and lightweight wall mount system for flat panel displays that is universal and will fit and support any size TV panel, monitor, display, painting or picture frame.
3. Another object of the present invention is to provide a simple and lightweight wall mount system for flat panel displays that is strong, durable and vibration resistant (will not get lose when in use).
4. Another object of the present invention is to provide a simple and lightweight wall mount system for flat panel displays that doesn't need stud support and can be mounted anywhere on a hollow wall using one simple tool like the screwdriver.
5. Another object of the present invention is to provide a simple and lightweight wall mount system for flat panel displays that can be mounted anywhere on any wall.
6. Another object of the present invention is to provide a simple and lightweight wall mount system for flat panel displays, LED monitors etc. that makes possible to hang them on the wall with a minimum gap between wall and back of display.
7. Another object of the present invention is to provide a simple and lightweight wall mount system for flat panel displays that allows TVs, monitors and the like to be mounted flush to the wall—with no gap at all.
8. Another object of the present invention is to provide a simple and lightweight wall mount system for flat panel displays that allows easy access to the back of the TV or monitor for cable/cord installation and servicing.

9. Another object of the present invention is to provide a simple and lightweight wall mount system for flat panel displays that can be made at a low cost.
10. Another object of the present invention is to provide a simple and lightweight wall mount system for flat panel displays that has an extremely small carbon footprint from production, transportation, storage, use and disposal, which includes minimalistic and environmentally friendly packaging.
11. Another object of the present invention is to provide a simple and lightweight wall mount system for flat panel displays that is reversible, which means allowing the hooks to be attached to the display and the mount pegs to the wall or the other way around.
12. Another object of the present invention is to provide an "inside-wall" mount for flat panel displays where the screen of the display is flush with the wall surface.

After searching patents and pending applications related to the topic I haven't seen any prior teachings cover the main scope of the present invention. The scope of the present invention clearly extends beyond the known prior art and is further defined by the following description and drawings.

BRIEF DESCRIPTION OF THE DRAWINGS

The stated and unstated objects of the present invention will become apparent in conjunction with the following drawings accompanied by a brief description of the features and their anticipated utility.

DETAILED DESCRIPTION OF THE DRAWINGS

The present invention, as described, is usable with most existing brands and sizes of TVs, displays and monitors with the exception of the very smallest and the largest. This section of the disclosure intends to show and describe just a few of the preferred embodiments with the purpose of illustrating the main features and advantages. These examples focus mainly on mounting flat panel TV displays and do not encompass the entire scope of the present invention but it will be apparent to someone skilled in the art that other flat objects can be hung the very same way.

Figure 1:
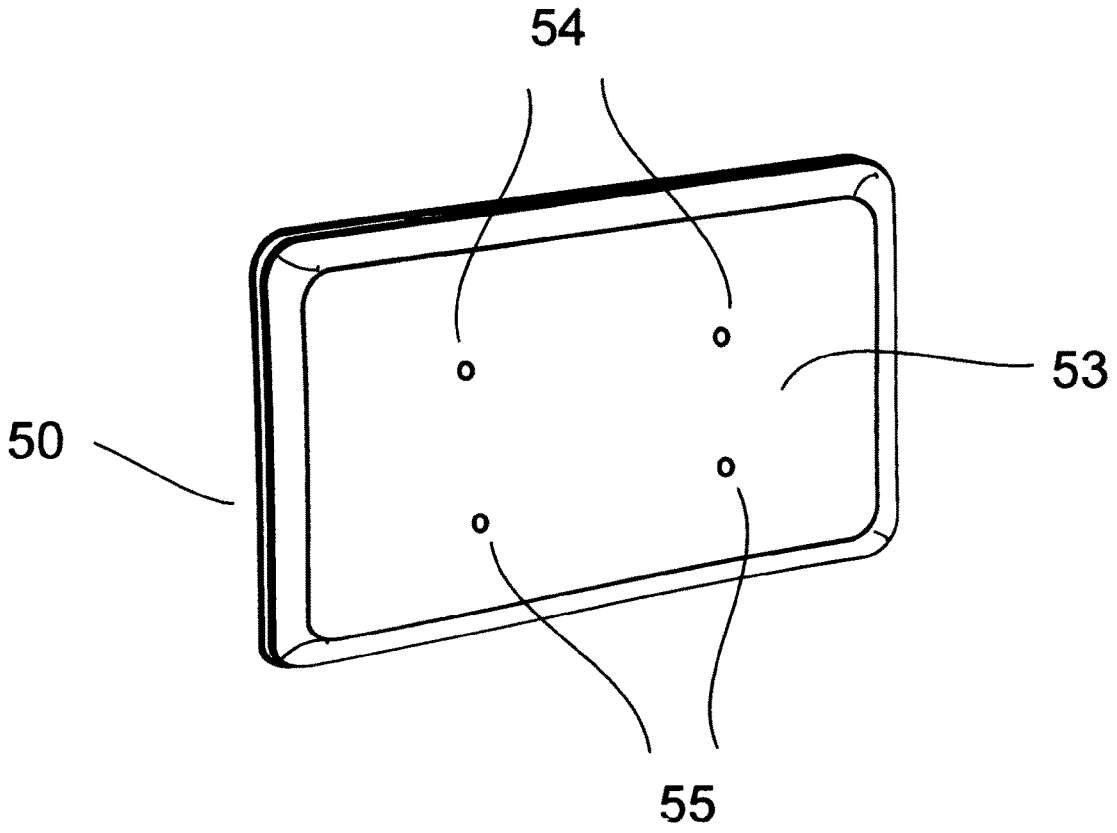
FIG. 1 is a perspective view of the back of the display with the mount holes visible.

Looking at FIG. 1 a display 50 can be seen from the back with a pair of upper mounting holes 54 and a pair of lower mounting holes 55 visible on the rectangular back panel 53.

All 4 mount holes must be utilized with mounts that offer swivel, tilt or full motion functions.

The present invention, however, takes advantage of the fact that the weight of a TV display hanging on the wall, especially the latest ultra light flat screens, can be fully supported using only the two upper mounting holes 54.

Figure 2:
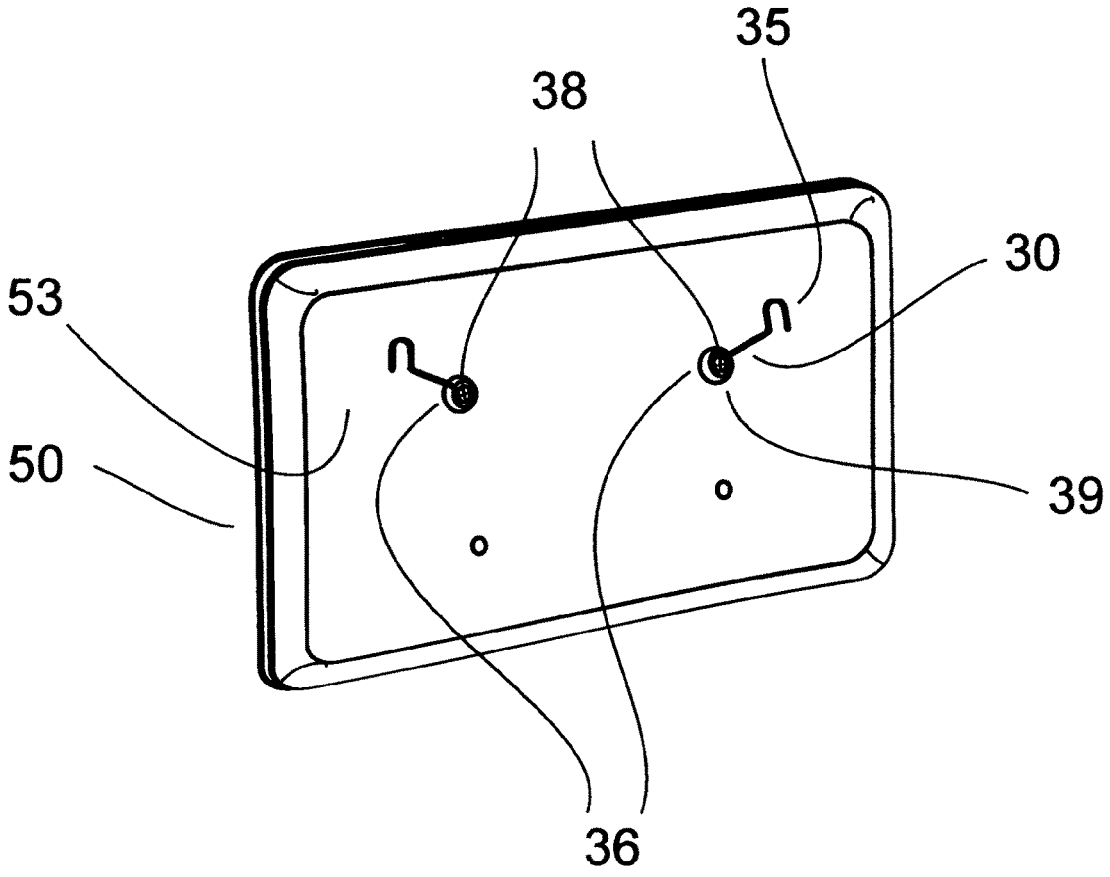
FIG. 2 is a perspective view of the back of the display with the flat hooks attached to the upper mounting holes.

FIG. 2 shows the back panel 53 of the display 50 with a pair of flat hooks 30 attached to the upper mounting holes 54 from FIG. 1 via properly sized and profiled machine screws 38 with a soft rubber washers 36 inter-imposed between the back panel 53 and the eye 39 of the hook 30.

The soft rubber washers 36, which might have adhesive side, provide cushioning and allow rotation of the hook 30 but prevent the machine screws 38 from rotating, getting loose and undone. The u-section 35 of the hook 30 is sized to engage with the sleeved washers of FIG. 3.

Figure 3:
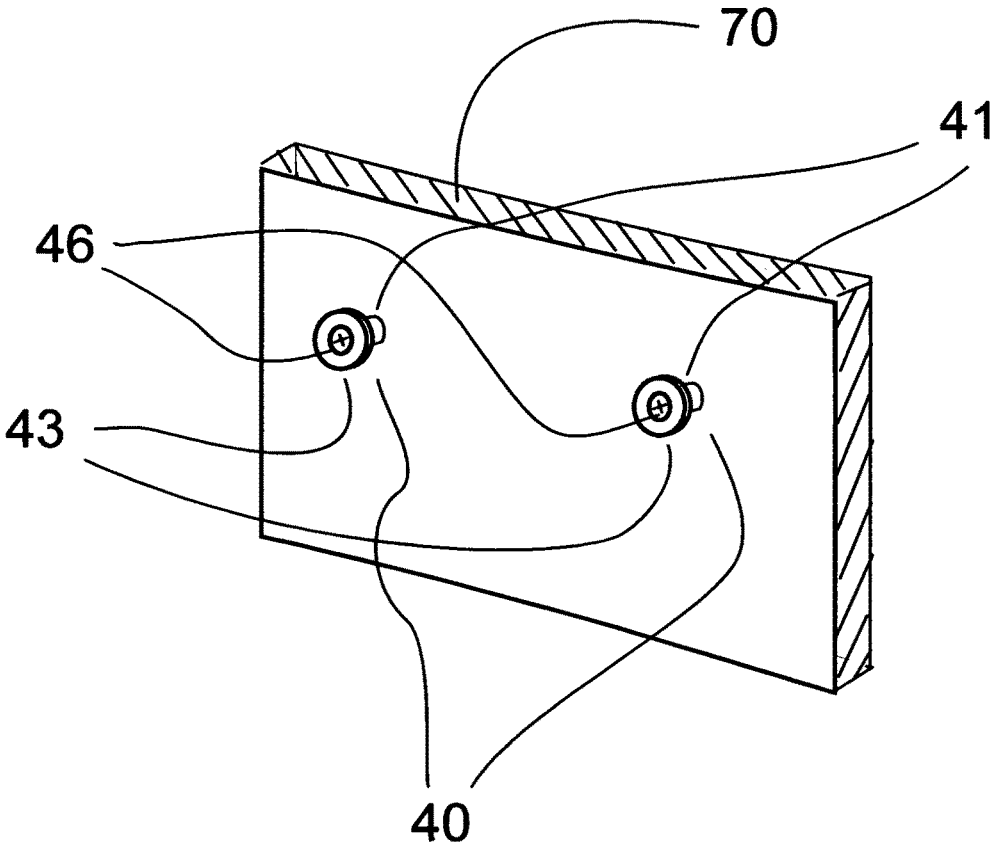
FIG. 3 is a perspective top view of a wall section with a pair of sleeved washers mounted thereon.

FIG. 3 shows a pair of sleeved washers 40 attached to the wall 70 via properly sized and anchored screws 46 to withstand the weight of the display.

The sleeves 41 are sized to fit inside the u-section 35 of the hook 30 from FIG. 2 and bear the weight of the display. The shoulder 43 of the sleeved washer 40 is sized to keep the hook 30 in place and prevent it from slipping off of the sleeve 41.

Figure 3A:
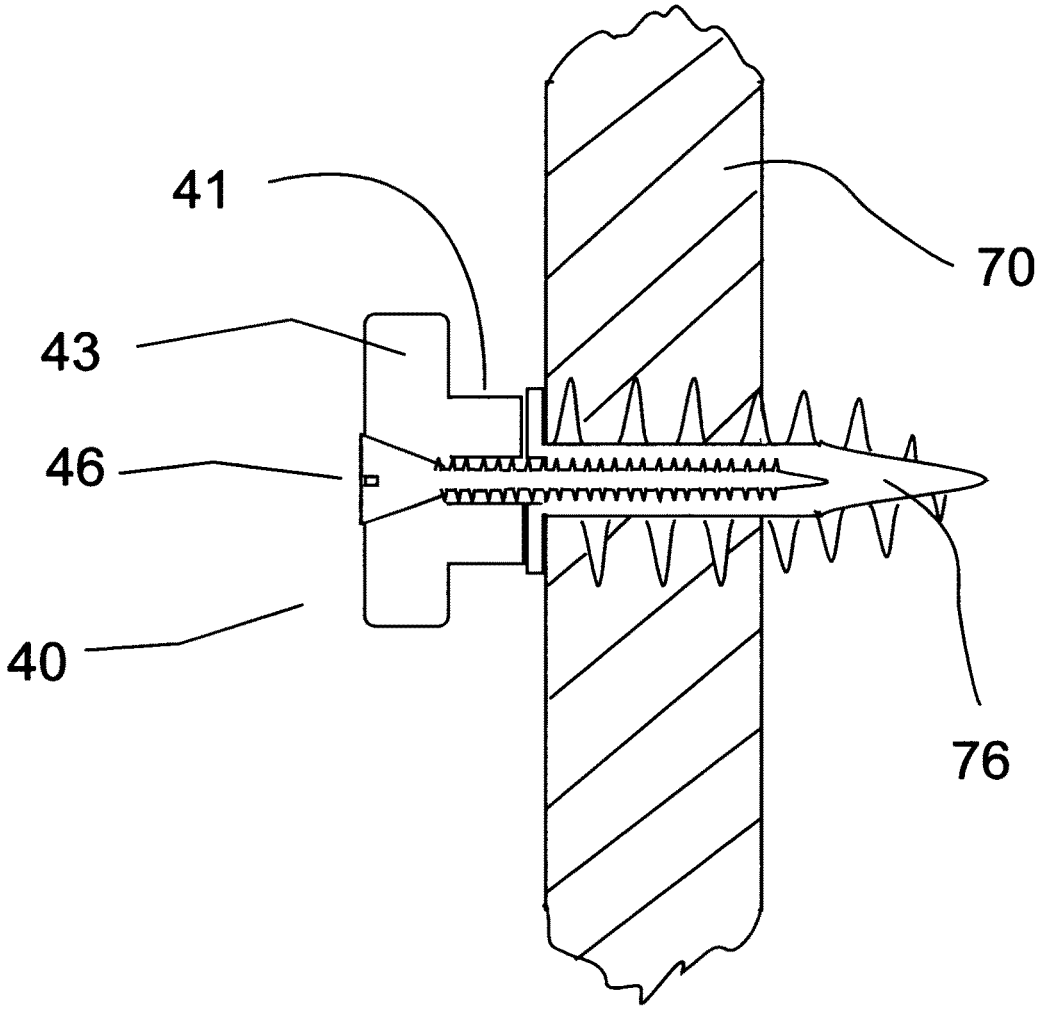
FIG. 3*a* is a close up cross-section view of the sleeved washer attached to the wall.

FIG. 3*a* shows a close up cross-section of the sleeved washer 40 mounted onto a hollow wall 70 and held via anchor screw 46, which is threaded into the anchor 76. There are many kinds of anchors and screws that can be utilized depending on the kind of wall. Most anchors, however, need to be inserted into a pre-drilled hole.

Figure 4:
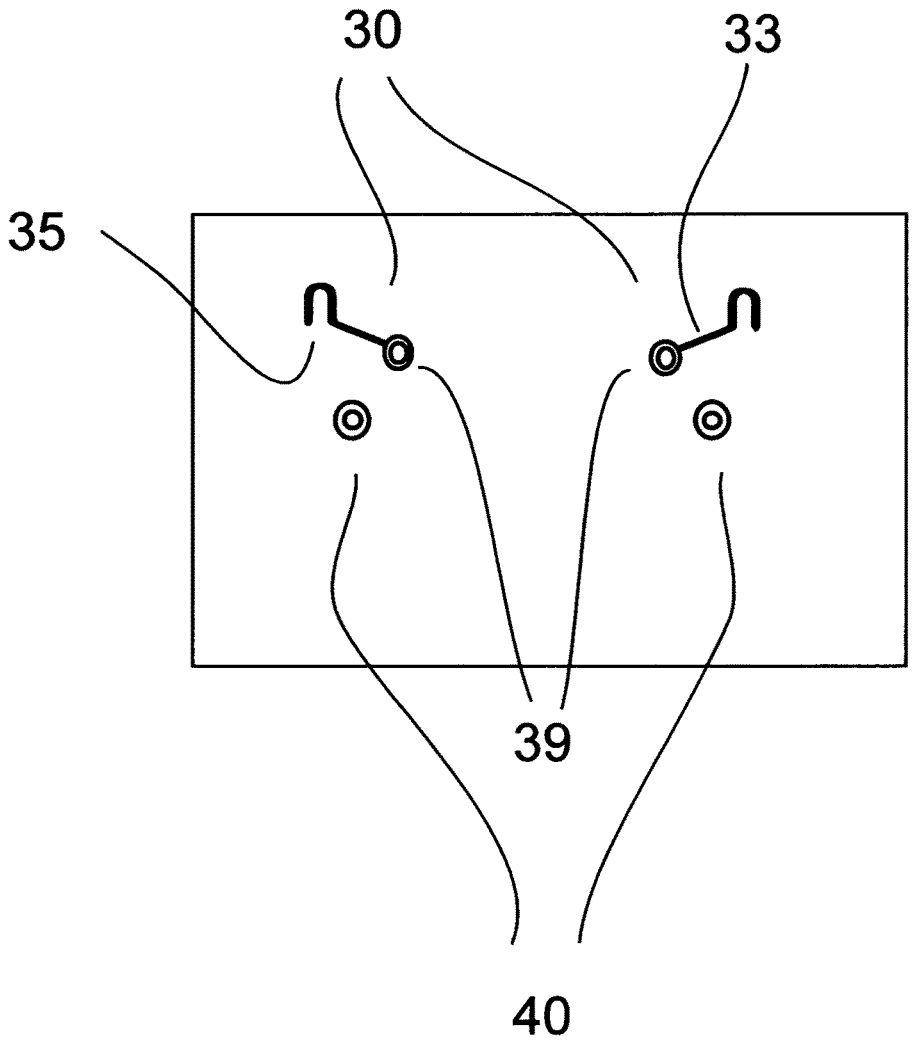
FIG. 4 is a frontal view of the flat hooks in the outward configuration ready to engage with the sleeved washers

FIG. 4 is a frontal view of the flat hooks 30 ready to engage with the sleeved washers 40 in the outward configuration. In this configuration the u-sections 35 are positioned outwardly, the hook stems 33 directly over and the hook eyes 39 inwardly in respect to the sleeved washers 40.

Downward motion of the hooks 30 in respect to sleeved washers 40 will cause the hook stems 33 to glide over the sleeves and make the u-sections 35 "lock" onto the sleeved washers 40.

Figure 4A:
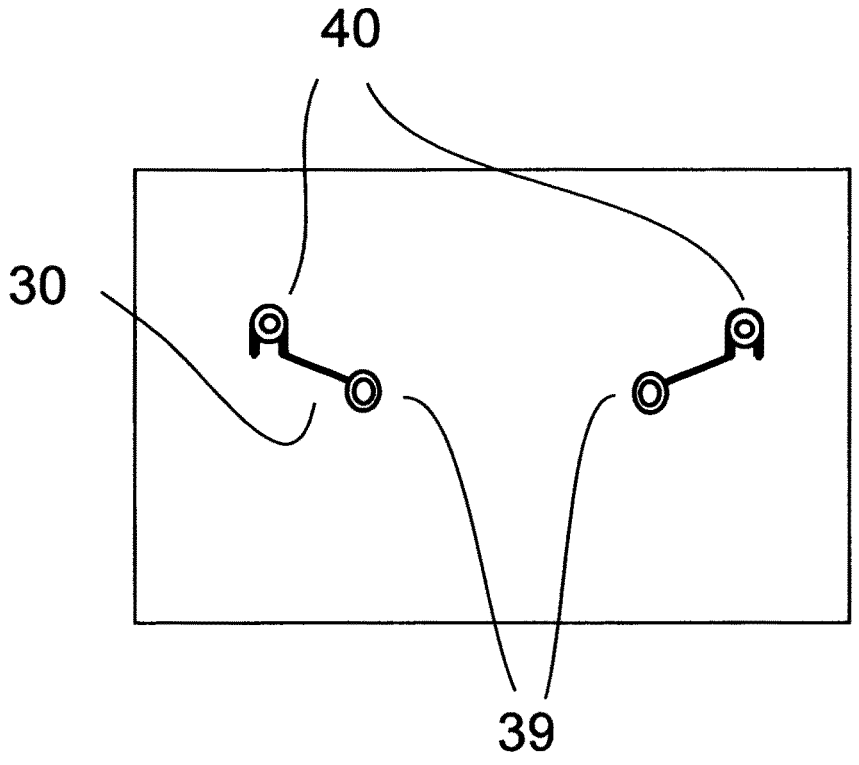
FIG. 4*a* is a frontal view of the flat hooks in the outward configuration engaged with the sleeved washers

FIG. 4*a* is a frontal view of the flat hooks 30 resting over the sleeved washers 40 in the outward configuration—hook eyes 39 to the inside.

The first configuration—with wall mounts wider than the mounting holes—is preferred for displays with narrow mounting hole pattern.

Figure 5:
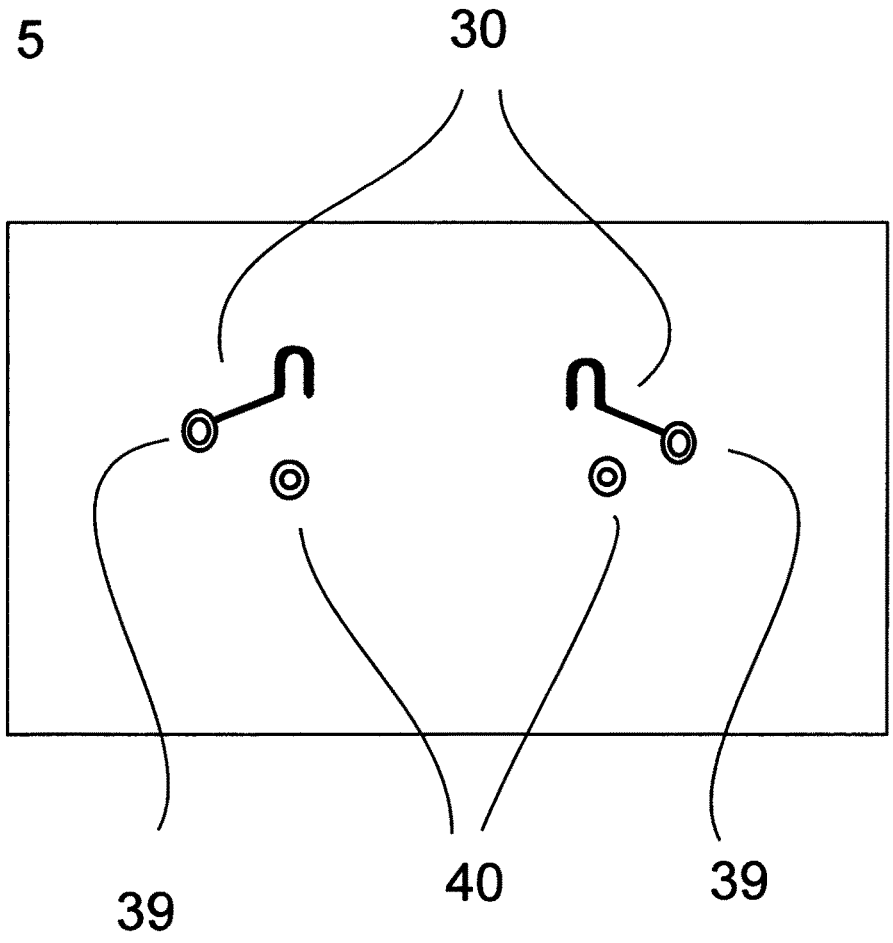
FIG. 5 is a frontal view of the flat hooks in the inward configuration ready to engage with the sleeved washers

FIG. 5 is a frontal view of the flat hooks 30 ready to engage with the sleeved washers 40 positioned inwardly and the hook eyes 39 outwardly.

Figure 5A:
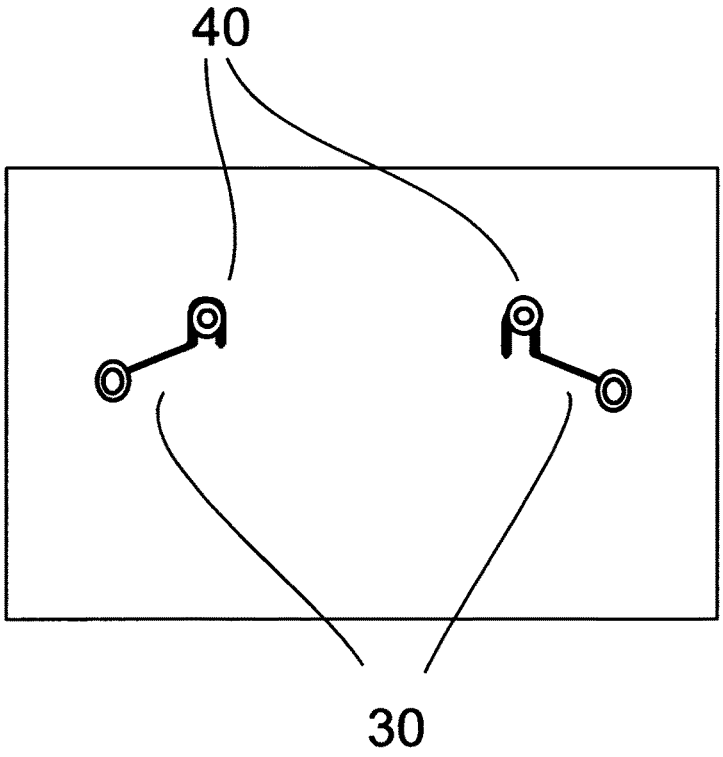
FIG. 5*a* is a frontal view of the flat hooks in the inward configuration engaged with the sleeved washers

FIG. 5*a* is a frontal view of the flat hooks 30 engaged with the sleeved washers 40 in the inward configuration This configuration—with wall mounts narrower than the mounting holes—is preferred for larger displays with extra wide mounting hole pattern to prevent the hooks being easily visible from the sides.

These are the two ways the flat hooks can engage with the sleeved washers that allow for easy installation and leveling of the display after hanging including limited vertical tilt/pitch adjustment of the display.

The flat hooks can be stamped or laser cut out of sheet metal of various thicknesses and it might be economically feasible making the hooks all uniform—one size and one thickness—one that would be sufficient for lighter displays. Supporting heavier displays would also be fairly simple, as the "thin" hooks could be used doubled or even tripled as needed to increase/multiply their weight bearing capacity.

This approach, besides assuring uniformity, makes it possible for lighter displays to have slightly smaller gap to the wall thank to the thinner hook, while saving raw materials and other costs.

The present invention proposes also another way to minimize or even completely eliminate the gap between the back of the display and the wall while allowing substantial tilting up of the bottom of the display.

Figure 6:
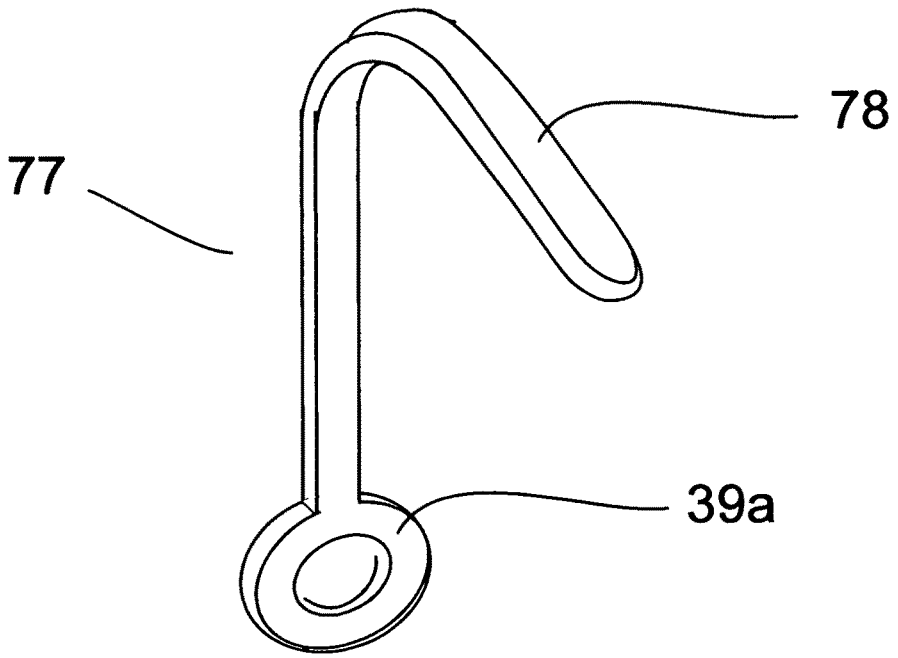
FIG. 6 is a perspective view of the hook bent in a different way. This hook shape is also known as the downhaul hook.

FIG. 6 is a perspective view of the downhaul hook 77 which is bent in a different way than the flat hook 30. The hook eye 39*a* is perpendicular to the plane along which the angled section 78 was bent.

Figure 7:
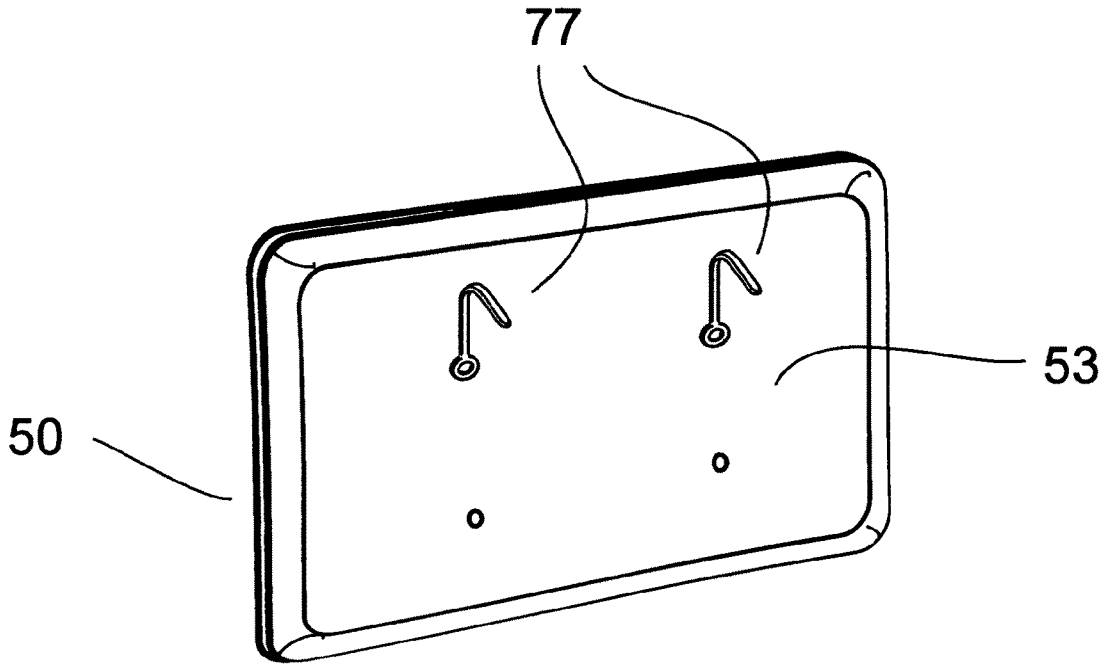
FIG. 7 is a perspective view of two downhaul hooks mounted onto the back of the display

FIG. 7 is a perspective view of the downhaul hooks 77 mounted onto the back panel 53 of the display 50.

To hang the display 50 onto a hollow wall using downhaul hooks 77 is extremely simple and easy. It only requires two holes in the drywall—spaced, sized and angled correspondingly to receive the angled sections 78 of downhaul hooks 77. Hanging it is easier for two people.

A single person having view limited when holding the display in front of his/her face, might benefit from additional v-shaped guiding fixtures helping guide the tips of the hooks into the corresponding holes in the wall.

Figure 8:
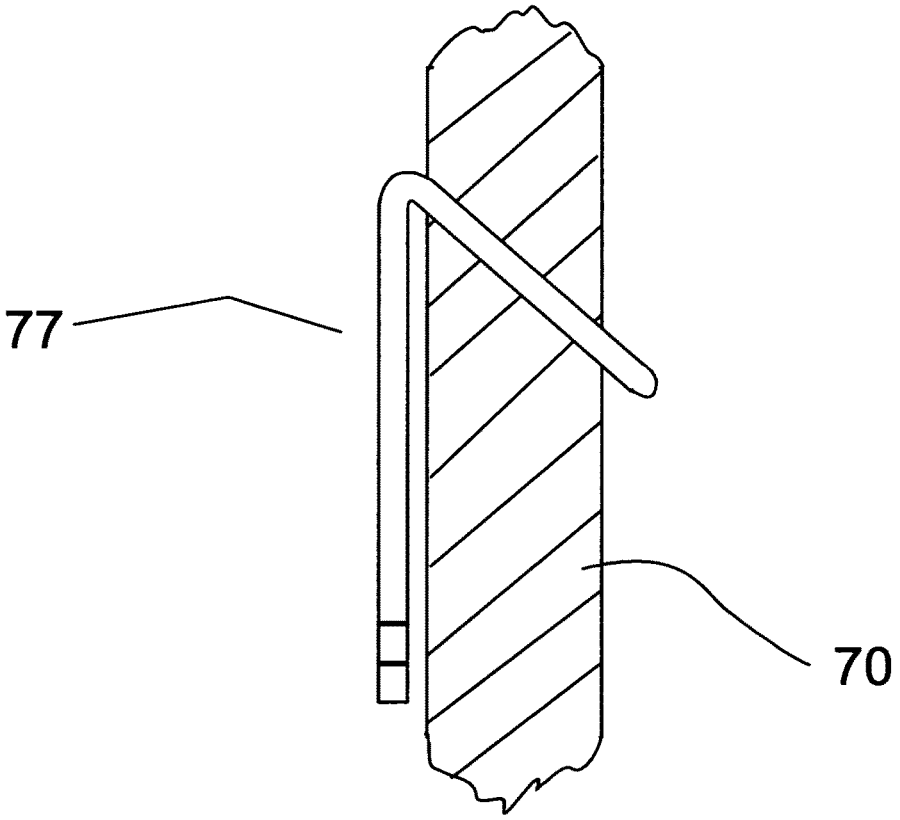
FIG. 8 is a cross section view of the downhaul hook inserted into a wall.

FIG. 8 is a close up cross section view of the downhaul hook 77 hanging on a wall 70.

Figure 9:
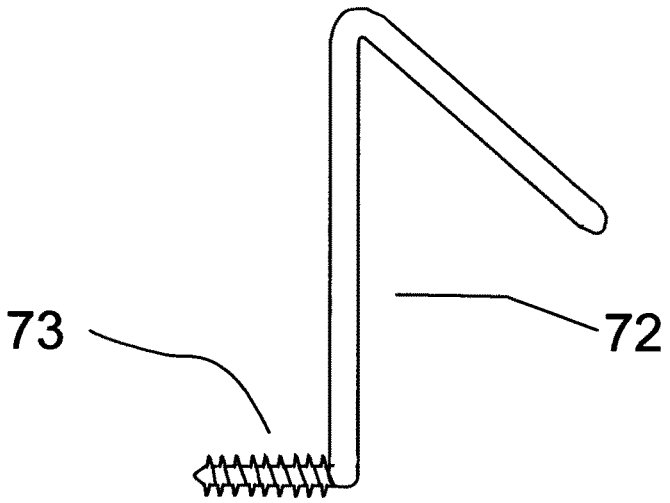
FIG. 9 is a perspective view of a hook that similar to the downhaul hook but instead of the eye it has an extending threaded section which threads directly into the mounting holes.

FIG. 9 is a perspective view of a hook that is similar to the downhaul hook—it is the z-hook 72. It has a threaded section 73 which threads directly into the mounting holes on the back panel of the display. This kind of hook is best made out of round stock—pre-threaded then bent.

Figure 10:
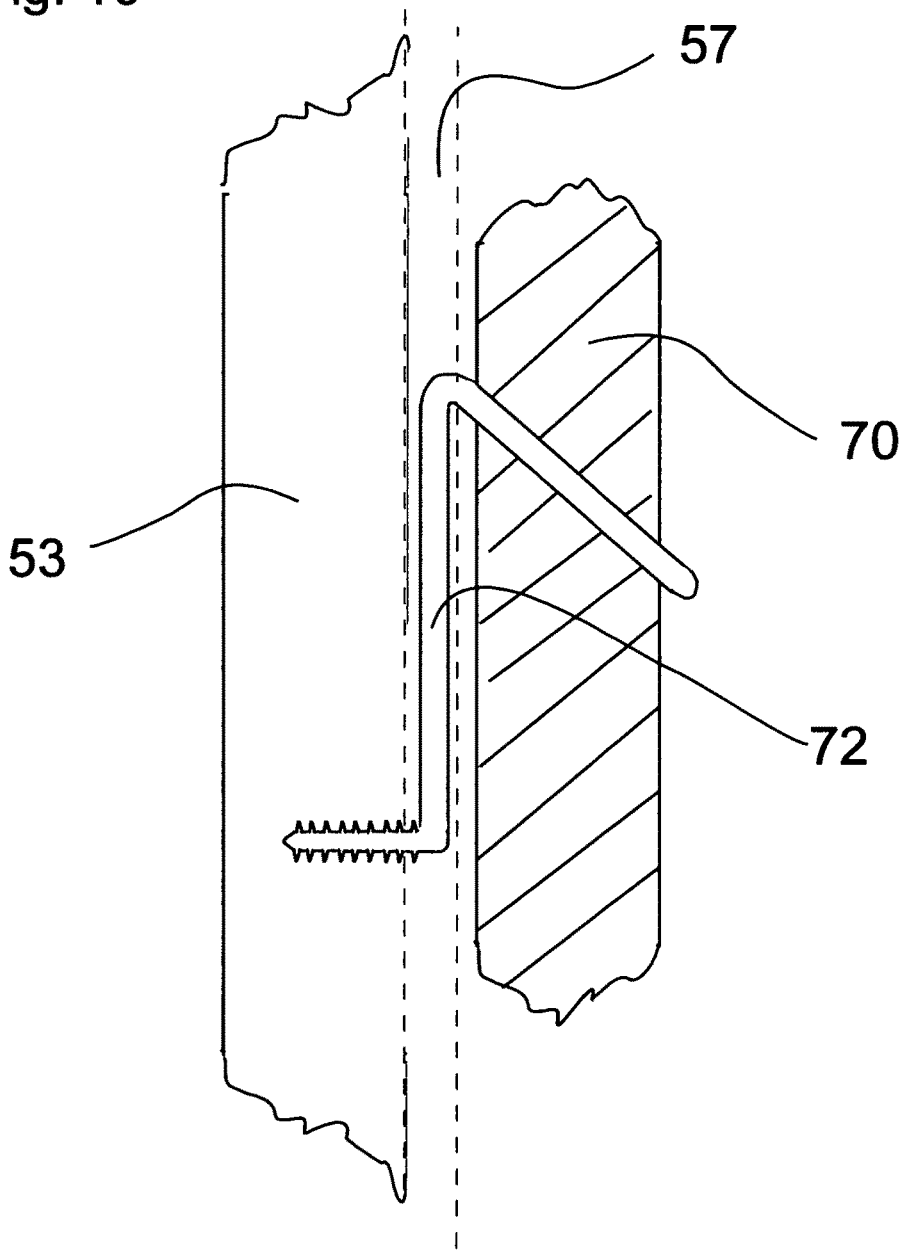
FIG. 10 is a close up cross-section view of the back panel of the display with a recessed section containing the z-hook threaded into the back of the display without leaving any gap to the wall and making any mounting hardware invisible.

FIG. 10 is a close up cross-section view of the back panel 53 of the display 50 of FIG. 1 with a back panel recess 57 depicted here by the vertical parallel broken lines showing the back panel 53 nearly touching the wall 70 (for illustrational purposes only) and the stem of hook 72 clearly between the broken lines allowing the back of the display (in reality) to be flush with the wall touching it without leaving any gap whatsoever and making any mounting hardware invisible.

When the pivotal radius of the to be tilted display aligns with the angled hole channel in the drywall, the display can be easily tilted up for wire installation and servicing requiring access to the back panel.

If getting the back panel of the display flush with the wall is not enough the present invention proposes another embodiment for nesting the flat panel display inside the wall and having the display's screen flush with the wall. A thin nesting tray with easy release locks and ready power and signal hook-ups can be used to facilitate mounting and shielding the display from dust inside the wall.

Figure 11:
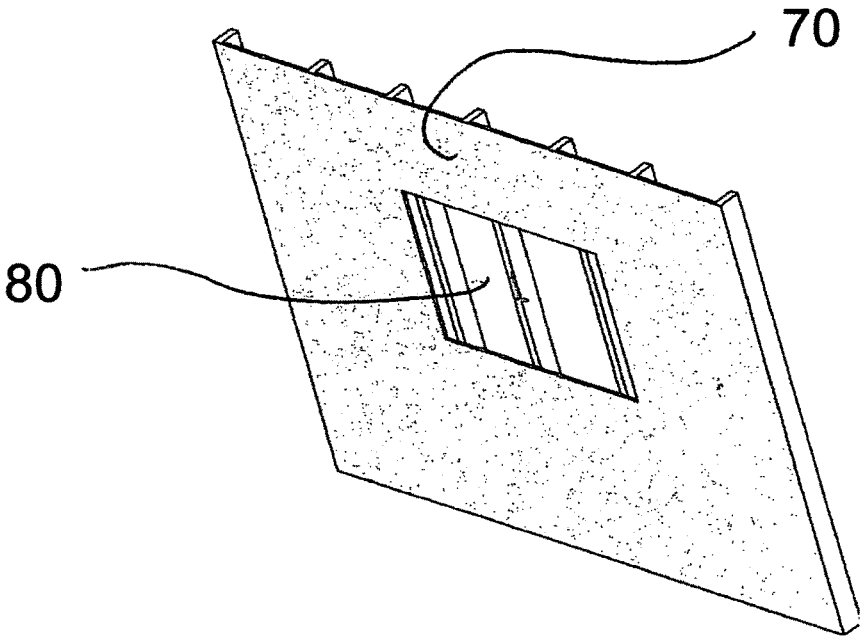
FIG. 11 is a top perspective view of a hollow wall with a rectangular cutout in the center.

FIG. 11 is a top perspective view of a hollow wall 70 with a rectangular cutout 80 in the center.

Figure 12:
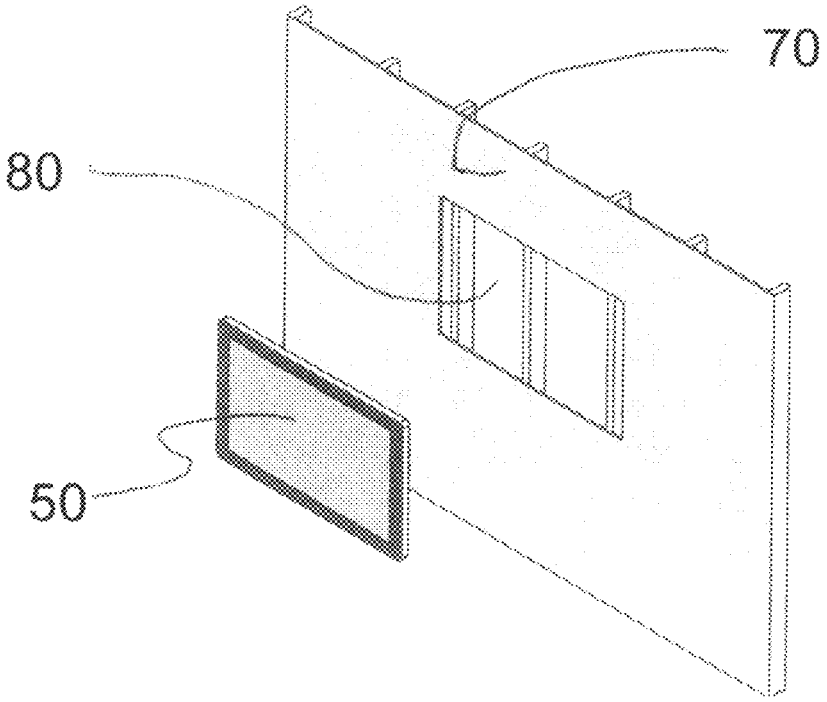
FIG. 12 is a top perspective view of a hollow wall with a rectangular cutout in the center and a similarly sized rectangular TV display next to it.

FIG. 12 is a top perspective view of a hollow wall 70 with a rectangular cutout 80 in the center and a similarly sized rectangular TV display 50 aligned next to it.

Figure 13:
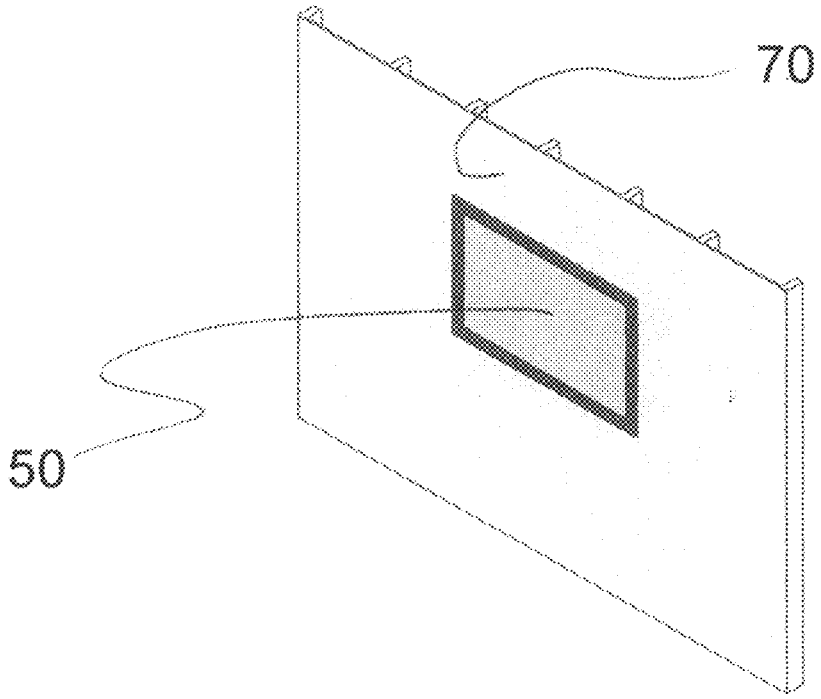
FIG. 13 is a top perspective view of a hollow wall with a rectangular TV display mounted flush in the center.

FIG. 13 is a top perspective view of a hollow wall 70 with a TV display 50 nesting in the center of it flush with the wall surface.

Disclaimer: The above drawings are for illustrational purposes only and may be not to scale, lacking details and/or some components.

While the present invention has been described in some detail with reference to the particular illustrative embodiments, it is not to be restricted by the discussed embodiments but only to be defined by the appended claims. It is understood that those skilled in the art can easily change or modify the above described and below illustrated embodiments without departing from the true scope and spirit of the present invention.

The invention claimed is:

1. A wall-mount hanger adapted to hang a flat object having a front face and a rear face on a wall comprising:

a pair of flat hooks formed and configured to pivotally attach to and rotate parallel to said rear face of said flat object; each said hooks includes a hook stem and U-shaped section;

a plurality of mounting members are attached to said wall; and a set of retaining means for said pair of flat hooks and said mounting members, wherein said pair of flat hooks is adapted to interlock with each said mounting members such that said flat object remains securely suspended on said wall allowing the rear face of said flat object to be flushed with said wall, and wherein each said U-shaped section of said pair of said flat hooks is configured and positioned to slide and lock onto corresponding pairs of said mounting members anchored to said wall.

2. The wall-mount hanger according to claim 1, wherein said set of retaining means including anchor screws positions both said pair of flat hooks and said mounting members, to facilitate interlocking of said pair of flat hooks with said corresponding pairs of mounting members anchored to said wall.

3. The wall-mount hanger according to claim 1, wherein said pair of flat hooks are pivotally moveable hooks that interlock with said corresponding mounting members in a manner that provides for pitch and level adjustments to said flat object after it is hung when securely suspended on said wall.

* * * * *